US006202366B1

(12) United States Patent
Snyder et al.

(10) Patent No.: US 6,202,366 B1
(45) Date of Patent: Mar. 20, 2001

(54) WATER COLLECTION PAN FOR UNIT MASONRY WALL SYSTEMS AND DRAINAGE SYSTEM INCORPORATING SAME

(76) Inventors: Jeffrey Thomas Snyder, 508 Gardner, Northville, MI (US) 48167; Jerald Allen Snyder, 7796 Thunder Bay, Pinckney, MI (US) 48169

( * ) Notice: Subject to any disclaimer, the term of this patent is extended or adjusted under 35 U.S.C. 154(b) by 0 days.

(21) Appl. No.: 09/248,801

(22) Filed: Feb. 11, 1999

(51) Int. Cl.[7] ..... E04D 13/00

(52) U.S. Cl. ..... 52/97; 52/169.5; 52/302.1; 52/302.3; 52/302.6

(58) Field of Search ..... 52/169.5, 502.6, 52/302.3, 97, 302.1, 505, 712

(56) References Cited

U.S. PATENT DOCUMENTS

| | | | | |
|---|---|---|---|---|
| 835,669 | | 11/1906 | Eckley . | |
| 1,746,816 | | 2/1930 | Boes . | |
| 2,657,570 | | 11/1953 | Moore . | |
| 2,934,931 | | 5/1960 | Johnson . | |
| 3,293,810 | * | 12/1966 | Cox | 52/302.6 |
| 3,429,084 | | 2/1969 | Brewer . | |
| 3,668,829 | | 6/1972 | Nelson . | |
| 4,253,285 | | 3/1981 | Enright . | |
| 4,272,931 | | 6/1981 | Stanizzo . | |
| 4,375,143 | * | 3/1983 | Godlewski | 52/98 |
| 4,612,742 | | 9/1986 | Bevilacqua . | |
| 4,907,385 | | 3/1990 | Biodrowski . | |
| 4,910,931 | * | 3/1990 | Pardue | 52/169.5 |
| 5,115,614 | * | 5/1992 | McGrath | 52/169.5 |
| 5,120,162 | | 6/1992 | Parker . | |
| 5,274,968 | * | 1/1994 | Pardo | 52/97 |
| 5,596,857 | * | 1/1997 | Besche | 52/421 |

* cited by examiner

*Primary Examiner*—Carl D. Friedman
*Assistant Examiner*—Kevin McDermott
(74) *Attorney, Agent, or Firm*—Brooks & Kushman P.C.

(57) ABSTRACT

A water drainage system and water collector pan for use in unit masonry block walls includes a plurality of water collection pans which may be quickly placed on the top surface of the course of masonry block units over the length of a selected block wall course for collecting the water drained through the interior cavities of the upper courses and directing the water to the exterior of the wall. The collector pans includes a substantially planar collector surface, which, when installed on the block, extends from the front to the rear edges of the block, and generally vertical ridges surrounding the front, rear and side edges of the collector portion and extending to a height slightly less than the height of the bed joint between the blocks, and a weep spout extending outward from the collector surface over the portion of the block to be covered by the bed joint to provide an exit for the collected water from the interior of the wall.

14 Claims, 6 Drawing Sheets

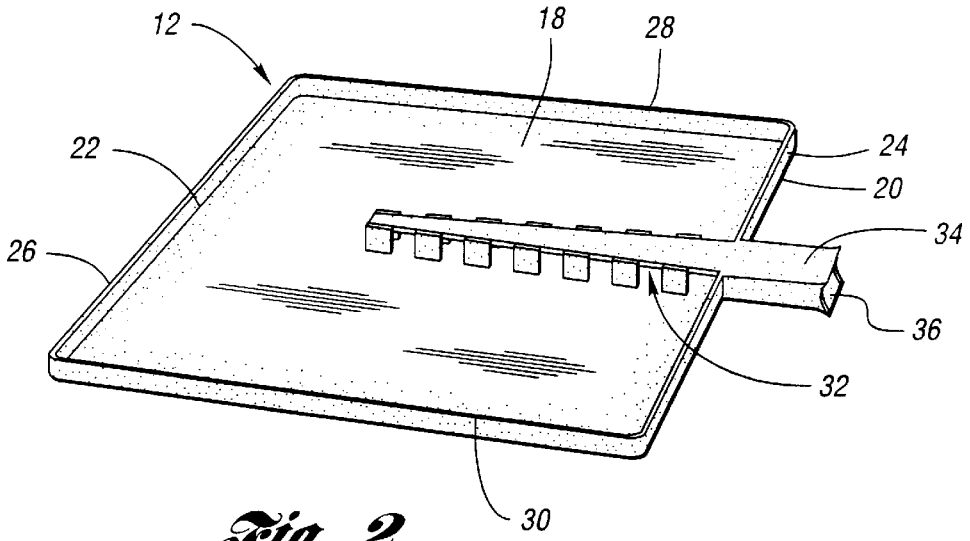
Fig. 2
Fig. 3
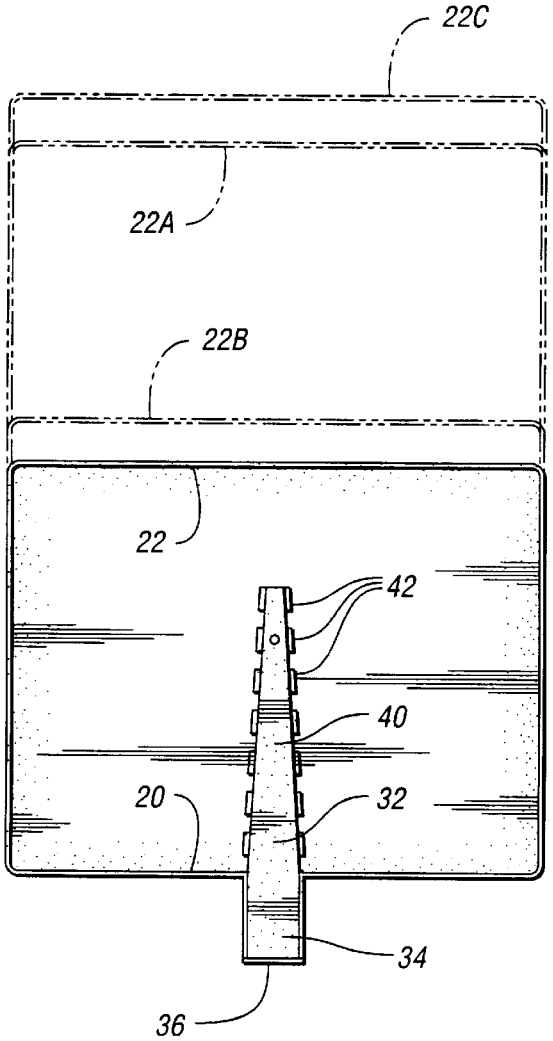

WATER COLLECTION PAN FOR UNIT MASONRY WALL SYSTEMS AND DRAINAGE SYSTEM INCORPORATING SAME

TECHNICAL FIELD

This invention relates to a water collection pan adapted for installation in unit masonry wall systems, as well as a drainage system employing a plurality of the collection pans.

BACKGROUND OF THE INVENTION

One of the most common and versatile methods of building construction employs concrete masonry. Concrete masonry units (C.M.U.) are manufactured in various sizes, shapes, colors, and surface finishes for use in a wide variety of applications. The most common C.M.U. shapes include standard (or stretcher) units, open-ended (including bond beam, lintel, and knock-out) units, as well as single and double open-end units. The C.M.U.'s come in a number of relatively standard dimensions. Typical sizes and shapes of C.M.U.'s are illustrated in National Concrete Masonry Association (NCMA) Technical Bulletin No. TEK 2-1A (1995), the disclosure of which is incorporated herein by reference.

Other types of units besides C.M.U.'s are also commonly employed in constructing unit masonry wall systems. These include bricks (and other clay or shale units), structural tile, glass units, stone, and pre-cast stone. As used hereinafter, "unit", "masonry unit," or "block" is intended to include any construction unit utilized in building unit masonry wall systems including those units described above.

Different sizes, shapes and types of masonry units are often utilized in combination. The units are typically laid up with mortar and, optionally, with steel reinforcement, grout, and other accessories to form unit masonry wall systems of enumerable variety in size and shape. The units each often have one or more vertically extending interior cavities hereinafter referred to as "cores" so that, when multiple courses of the blocks are assembled to form a wall, the cores of the blocks are aligned to form unobstructed, continuous series of vertical spaces within the wall. Basic unit masonry wall system designs include single wythe, multiple wythe (such as cavity wall systems), and veneer systems.

A persistent problem in the design and construction of concrete unit masonry wall systems is the migration of water from the exterior of the block walls to the interior of the building. Designers and builders have tried various methods and apparatus to intercept the flow of water through masonry and direct it to the exterior of the structure. One conventional flashing approach is to install a continuous water impervious membrane at any location in block walls where the potential exists for water penetration, such as the top of walls at copings, at the base of parapets, over openings, beneath sills, over bond beams, at shelf angles, at the tops of foundations, and at the base of the wall, to serve to divert water to the exterior of the wall. The installation of flashing is, however, labor intensive, and therefore costly. In particular, conventional flashing is difficult and time consuming to properly install in block courses including rebar or other vertical reinforcement. In addition, conventional flashing is difficult to inspect since, once installed, flashing may not be evident from the exterior of the wall.

U.S. Pat. No. 5,115,614, issued to McGrath, discloses an integral flashing unit comprising a custom designed masonry block which includes a solid base and integral weep slot for collecting and directing water from the interior cavities of blocks installed in courses above the flashing unit and directing the water to the exterior of the wall. One drawback of the above-mentioned system is that it requires fabrication and shipment of a separate set of non-standard blocks for each construction job. Moreover, the nationwide acceptance and use of such specialty units is inhibited by the high costs of shipping the custom-made blocks.

U.S. Pat. No. 4,910,931, issued to Pardue, Jr., discloses a water collection and drainage system which includes a system of upper water collection pans suitable for installation in upper bond beam courses, which pans collect and direct the water through the vertical block cavities and lower block courses to another series of collection pans at a lower beam block course, which in turn direct the water to base collection pans at the lower most beam block course where the water is directed to the exterior of the wall through weeping spouts. Drawbacks to this system include the cost and complexity of installation of the multiple tiers of collection pans, as well as design limitations in the system which require installation solely in bond beam courses.

BRIEF SUMMARY OF THE INVENTION

It is therefore an object of the present invention to provide an effective drainage system for unit masonry wall systems which can be fabricated, shipped to construction sites, and quickly installed during construction of unit masonry wall systems.

In carrying out the above and other objects, the drainage system of the present invention includes a plurality of water collection pans which may be quickly positioned on the top surface of each of the blocks over the length of a selected block wall course for collecting water drained through the cores of the upper courses and directing the water to the exterior of the block wall through the bed joint. The collection pan of the present invention includes a substantially planar collector surface which may be positioned on the top surface of the block to extend across the width (i.e., from the front of the block to the rear of the block while maintaining inner and outer face shell bonds) to thereby collect any water which drains to the top surface of the block from the cores of the blocks in the upper courses. The pan preferably includes generally vertically extending ridges surrounding the collector surface to retain any water that is collected and direct it out of the weep channel to the exterior.

Each of the collector pans also includes a weep channel extending generally horizontally from the front edge of the collector surface and including a weep spout which provides an opening through which water collected in the pan can escape. The weep spout typically extends outward from the pan on the top surface of the masonry unit to a point immediately adjacent the edge of the unit so that, when the pan is placed in position atop the masonry unit during installation, the weep spout extends through the bed joint mortar, with the weep spout opening at the exterior edge of the wall.

The system of the present invention includes a plurality of water collection pans installed adjacent one another across the top surface of each of the blocks in a selected course of a unit masonry wall so that the pans provide a substantially continuous water collection surface for water which drains through the vertical cores of the upper courses in the wall.

The system preferably also includes a plurality of bridge units, each of which spans the adjacent edges of two water collection pans to divert descending water into the adjoining pans.

The water collection pans may be fabricated from any water impervious, corrosion resistant construction material, such as molded plastic, sheet metal, or other corrosion resistant, water impervious material suitable for inexpensive mass production, as well as effective water collection and diversion in unit masonry wall systems.

The water collection pans are also preferably designed so that they can be inexpensively molded and compactly packaged for storage and shipment.

These and other objects, features and advantages of the present invention are readily apparent from the following detailed description of the best mode for carrying out the invention when taken in connection with the accompanying drawings.

BRIEF DESCRIPTION OF DRAWINGS

FIG. 2 is a perspective view of a water collection pan of the present invention;

FIG. 3 is a top view of the water collection pan showing the weep spout;

DETAILED DESCRIPTION OF THE INVENTION

Figure 1:
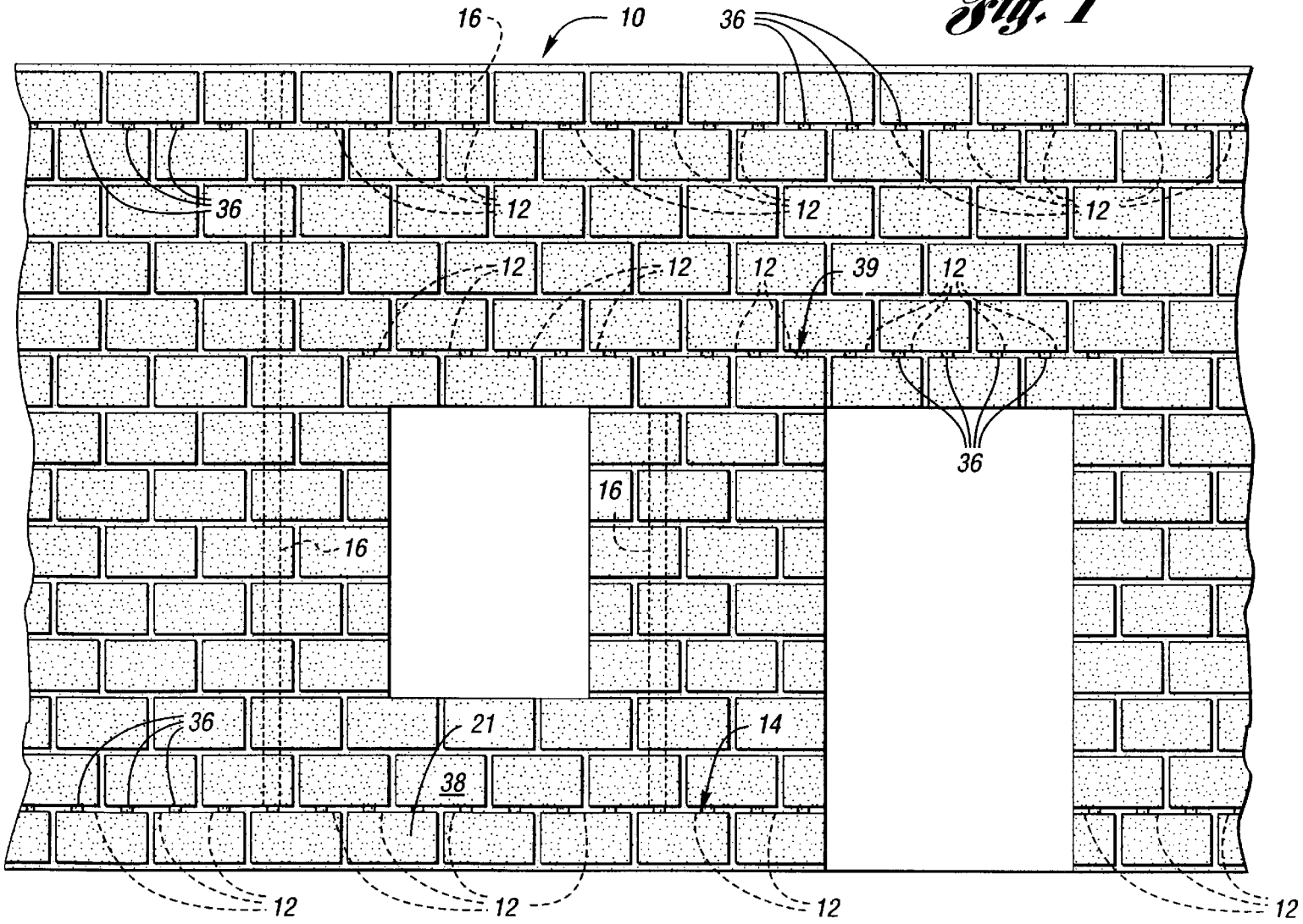
FIG. 1 is a front view of a typical exterior elevation of a masonry block wall employing the drainage system of the present invention.

Referring to FIG. 1 of the drawings, the masonry block wall drainage system of the present invention, generally indicated as 10, includes a plurality of water collection pans 12 positioned on the top surface of the lower course 14 of the block wall for collecting water drained through the cores 16 of the upper courses, and directing the water to the exterior of the block wall. In the illustrated embodiment, the water collection pans 12 (shown in FIG. 2) each include a substantially planar collector surface 18 which is positioned on the top surface of a block 21 in the lower course 14 during installation of the wall. The front edge 20 and rear edge 22 of the collector surface each preferably include vertical ridges 24 and 26, respectively, which extend upward from the collector surface (and, therefore, from the upper surface of the block 21 upon which the pan 12 is installed) at each of the front and rear edges 20, 22 of the pan. The pan 12 also preferably includes vertical ridges 28 and 30 which similarly extend upward from the upper surface of the block 21 along the side edges of the pan. The vertical ridges serve to contain any water which flows onto the collector surface of the pan and insure that the water migrates through the weep channel and out the weep spout to the exterior of the wall.

It should be noted that, as used herein, "front" and "rear," "inner" and "outer," "inward" and "outward" and like adjectives are used to describe direction from the perspective of an observer facing the masonry block wall from the exterior of the building, such that front, outward, outside, and forward refer to the portion of the installed block (or installed water collection pans) that is relatively nearer the exterior side of the wall. Likewise, rear, inward, or inside refer to the surface of the block wall that is on the interior side of the building.

A weep channel 32 including a weep spout 34 extends forward so that the channel opening 36 may be positioned in the bed joint between the block 21 on which the water collection pan 12 is installed and the immediately upper course block 38. When installed across the entire length of the selected course 14, the water collection pans form a water collection and drainage system which collects the water migrating through the cores 16 of the upper courses of the wall and directs the water outward through the weep channels 32 to the exterior of the wall. Additional water collection pans 12 may be installed elsewhere in the wall as required, such as, for example, to facilitate drainage over window and door openings (at 39) at Bond Beam or Lintel locations, at copings, and beneath sills, as well as any other location where conventional flashing has heretofore been recommended.

In the embodiment of the water collection pan 12 shown in FIG. 2, the weep spout 34 is preferably solid and generally rectangular in cross section at its open end 36 and extends about 1 inch (25.4) from the front edge 20 of the collector surface 18 across the top surface of the block forward towards the edge of the block. It will be appreciated, however, that the weep spout may be designed with other shaped cross sections, such as oval, circular, square, etc. without departing from the spirit of the present invention.

As shown in FIG. 3, solid weep spout 34 shields the channel 32 from the mortar which is installed on the top surface of the block during installation of the immediately upper course of the wall. The weep channel 32 also preferably includes a ceiling portion 40 which is spaced above, and is generally parallel to, the collector surface 18 of the pan, and extends into the pan from the front edge 20 of the pan. The ceiling 40 is suspended in position by a plurality of supports 42, thereby defining the weep channel 32 through which collected water can migrate through the weep spout 34.

Figure 4:
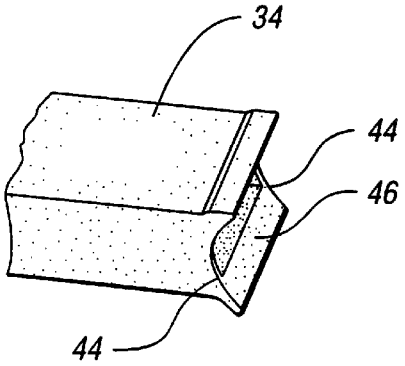
FIG. 4 is a partial side perspective view of the weep spout.
Figure 5:
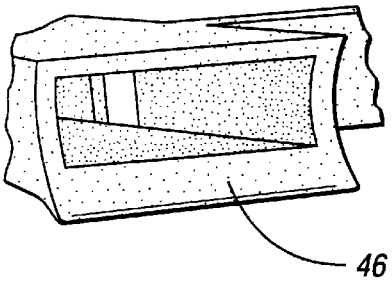
FIG. 5 is a front elevational view of the weep spout showing the weep channel opening.

FIG. 4 illustrates one embodiment of the weep spout which employs generally concave sidewall 44 at the channel opening 36 to minimize interference of the weep spout with masonry tooling used to define and smooth the bed joint during installation. FIGS. 4 and 5 also illustrate the lower drip edge 46 which extends outward from the weep spout 34, preferably at an angle of about 45°, to deflect moisture away from the wall system.

The height of the vertical ridges, as well as the height of the weep channel 32 and weep spout 34, is preferably less than about ⅜ inches, more preferably slightly less than ⅜ inches, so that the pan including the weep channel and spout fit within the space (defined by the thickness of the bed joint) between the lower course and upper course blocks.

The water collection pans 12 of the present invention may be fabricated from any water impervious material which is formable into the desired shape, and which has corrosion resistance properties sufficient for use in construction applications. Moldable plastic, preferably injection or blow molded polyvinylchloride (PVC) or polyethylene may be used. Alternatively, the pans may be cut or stamped and formed from a suitable sheet metal material such as galvanized or stainless steel, or copper.

In the illustrated embodiment a high density polyethylene composition is molded into an approximately 0.0625 inch (1.59 mm) thick pan with vertical ridges of about 0.3125 inches (7.94 mm). The 0.0625 inch (1.59 mm) weep spout preferably includes about a 0.2 inch (5.08 mm) by 0.64 inch (16.26 mm) channel opening 36. The drip edge is preferably angled at about 45°.

Figure 16:
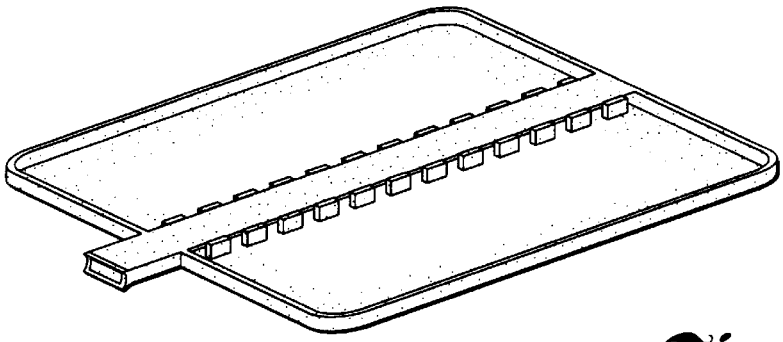
FIG. 16 is a perspective view of another embodiment of the water collection pan of the present invention.

The pan is preferably of a suitable width that the front and rear vertical ridges are spaced from the front and rear edges of the block upon which the pan is installed to allow for about 1 inch of mortar bond, thereby providing a full face shell bed joint between the upper and lower courses of the block. In the embodiment illustrated in FIG. 2, the weep spout ceiling 40 extends inward about 3.5 inches (88.9 mm) from the front edge 20 of the pan towards the center of the pan. In an alternative embodiment, illustrated in FIG. 16, the weep spout ceiling extends inward across the entire width of the pan, thereby providing a longer weep channel. The ceiling acts to suspend any mortar droppings, keeping the weep channel clear.

The water collection pan dimensions may, of course, be modified to accommodate any size masonry units consistent with the teachings of the present invention. One preferred width, suitable for use with United States standard 8 inch concrete masonry units (shown in FIG. 3), has a width (i.e., front edge-to-back edge dimension) of about 5.625 inches (142.88 mm) and a length of about 6.75 inches (171.45 mm), so that two water collection pans effectively cover the top surface of one 8 inch unit. Similarly, another preferred standard size water collection pan, suitable for standard United States 12 inch concrete masonry units (shown in partial phantom lines 22A in FIG. 3), includes a width of about 9.625 inches (244.48 mm) and a length of about 6.75 inches (171.45 mm). Other standard sizes, corresponding to commonly used blocks (shown in partial phantom lines 22B and 22C in FIG. 3) may also be mass produced, often by utilizing a single, adjustable mold.

Figure 6:
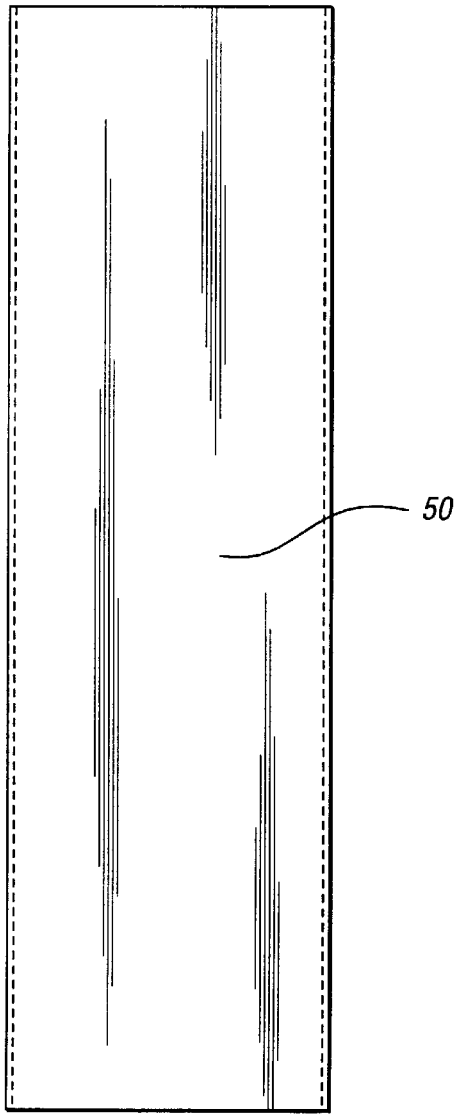
FIG. 6 is a top view of a bridge employed in the system of the present invention.
Figure 7:
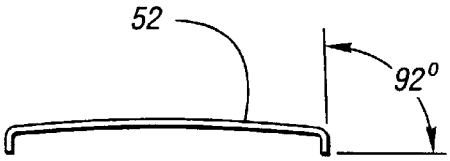
FIG. 7 is a front view of the bridge of FIG. 6.

Referring to FIGS. 6 and 7, the system 10 of the present invention also preferably employs a plurality of bridge units 50 which are installed over, and span, the side edges of adjacent water collection pans to divert descending water onto the collector surfaces of the adjacent pans. The bridge units 50 may be molded, stamped or extruded from a water impervious material such as polypropylene, other plastic, or sheet metal. The bridge unit 50 preferably has a top surface 52 which slops downward from the center of the bridge unit 50 towards the edge, thereby diverting water towards one or the other sides of the bridge unit 50 into one or the other of the adjacent pans spanned by the bridge unit 50.

Figure 8:
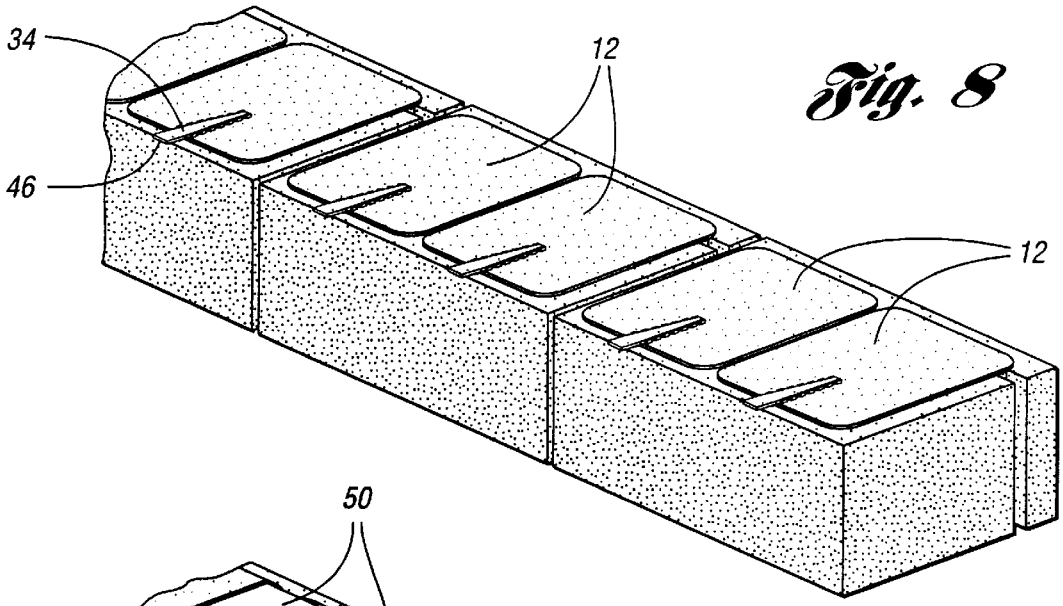
FIG. 8 is a partial perspective view of a plurality of water collection pans installed on a conventional block course.
Figure 9:
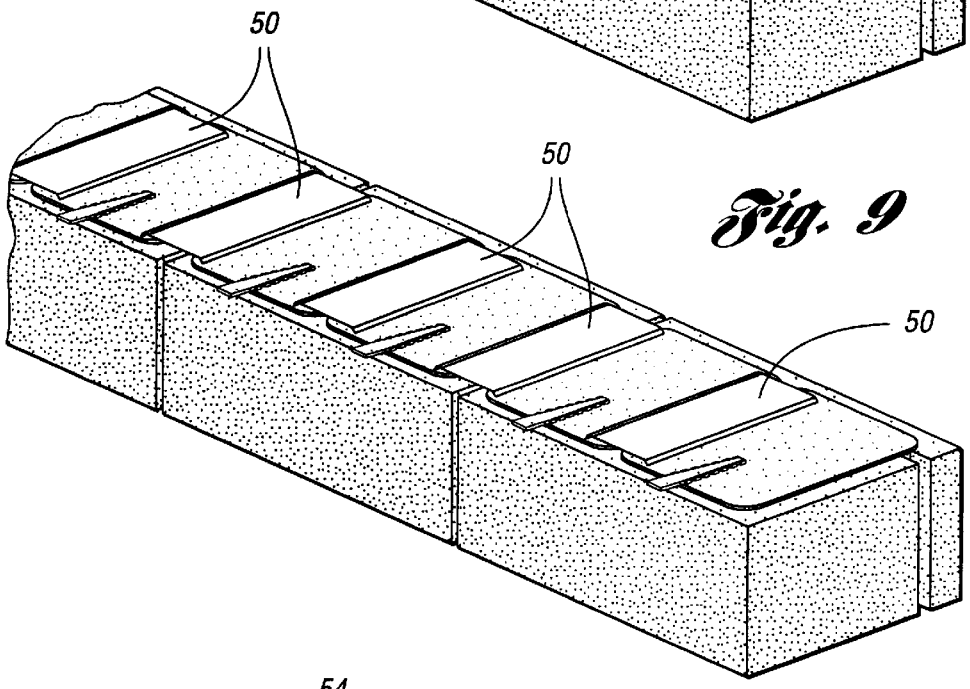
FIG. 9 is a partial perspective view of the water collection pans and bridges of the present invention installed on a conventional block course.

FIGS. 8–15 illustrate various installations of the system 10 of the present invention. Referring in particular to FIGS. 8 and 9, the drainage system is typically installed on a lower course of masonry blocks by placing water collection pans evenly along the top surface of each block, or evenly along a formed concrete foundation or slab. If preferred standard size blocks and water collection pans are utilized two evenly spaced pans will effectively cover the top surface of each block. The drip edge 46 on the weep spout 34 should extend slightly beyond the exterior face of the block unit it is resting on. The continuous row of water collection pans is then preferably spanned with bridge units 50 as illustrated in FIG. 9. Standard mortar spreading techniques are then utilized with mortar lapped first over the inner and second over the outer vertical ridges of the water collection pans. This stabilizes the collection pans during installation and will later help divert moisture onto the collector surfaces 18 of the pans 12. Install the upper course of blocks in a normal fashion.

Figure 10:
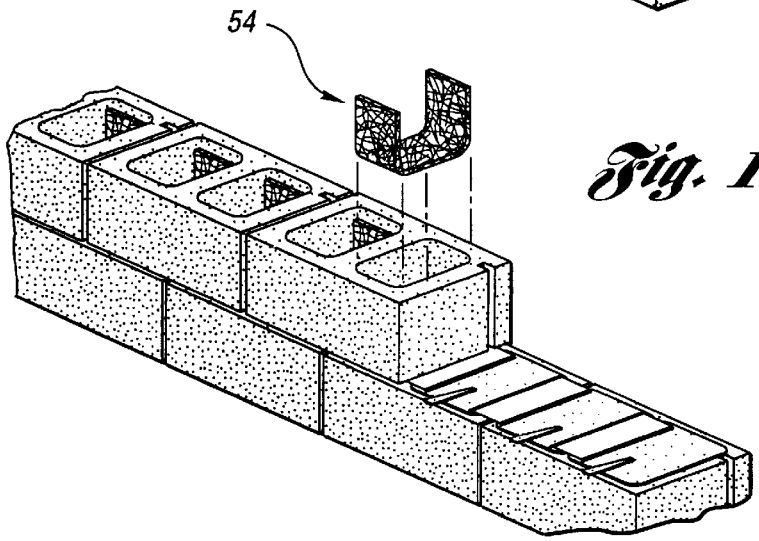
FIG. 10 is a partial perspective view of the drainage system of the present invention with drainage enhancing inserts installed in the cores of the adjacent upper course.

As illustrated in FIG. 10, a drainage enhancing material 54, such as MORTAR-WEB™ available from Masonry Speciality Products, Inc., of Northville, Mich., is preferably installed in a U-shaped configuration within the vertical cores of the upper course of blocks to reduce clogging from mortar and grout droppings during installation of the upper courses. Alternatively, a layer of pea stone, preferably about 2 inches, may be applied into the vertical core cavities.

Figure 11:
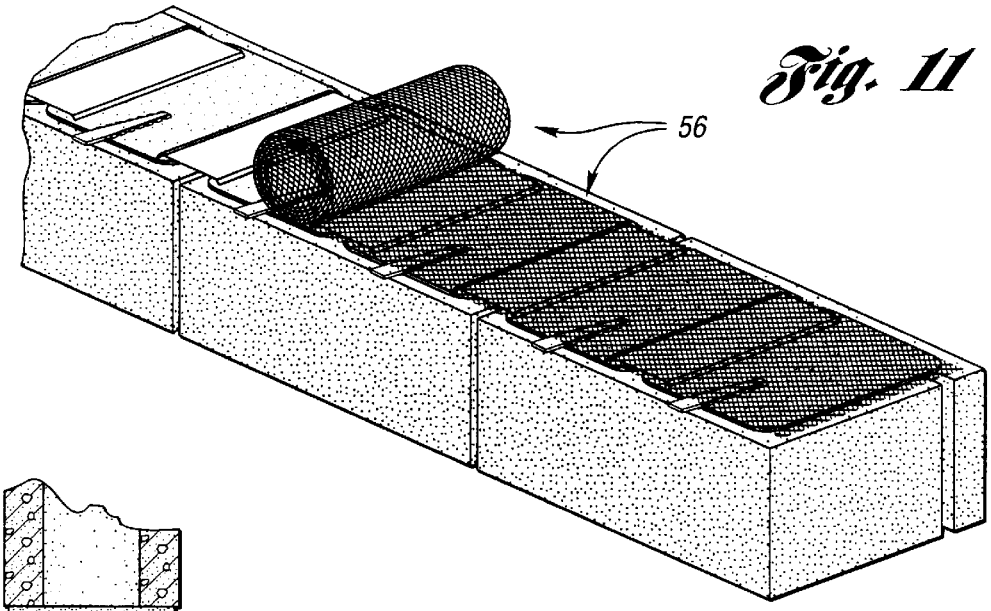
FIG. 11 is a partial perspective view of the system of the present invention including an insulation screen installed over the water collection pans and bridges on a conventional block course.
Figure 12:
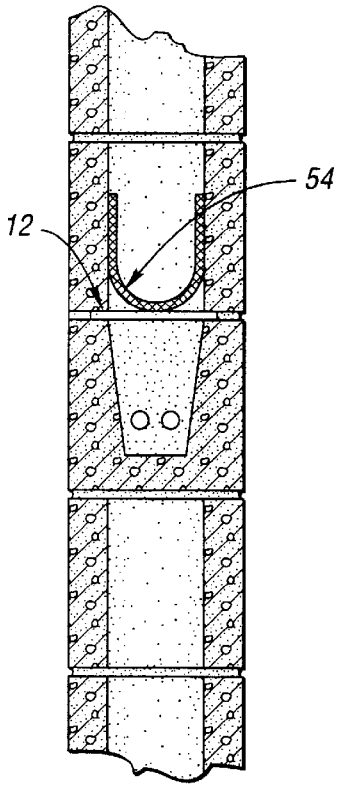
FIG. 12 is a side cross sectional view of the system of the present invention installed above a mid-wall bond beam course in a non-insulated wall.
Figure 13:
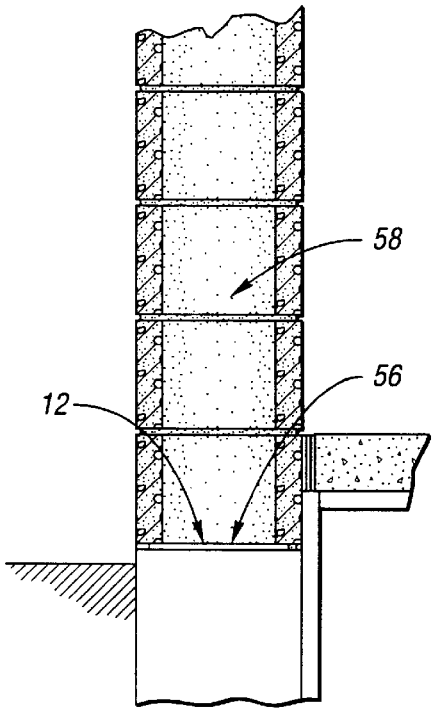
FIG. 13 is a partial side cross sectional view showing the system of the present invention installed at the base of an insulated wall.
Figure 14:
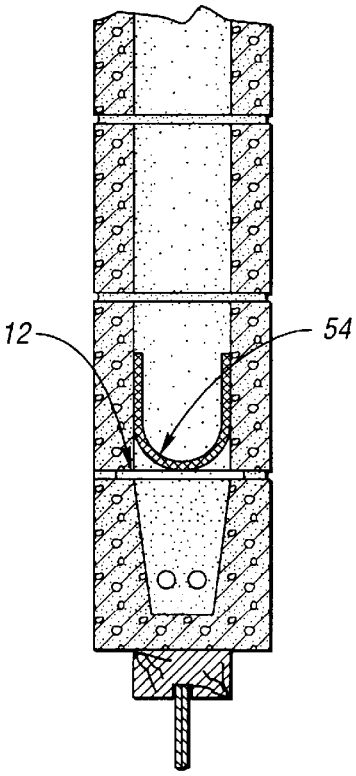
FIG. 14 is a partial side cross sectional view showing the system of the present invention installed at the head of a non-insulated wall.

FIG. 11 illustrates the preferred addition of a screening material 56 over the installed water collection pans 12 and bridge units 50 when the system 10 is being installed in insulated walls. One type of screen which may be employed is available as INSUL-SCREEN™ from Masonry Speciality Products, Inc., of Northville, Mich. The screen 56 prevents loose fill insulation from the vertical cores of the upper courses of blocks from filling the pans. Alternatively, a layer of pea stone may be installed in each vertical core above the water pans to prevent insulation from clogging the pans. It will be appreciated that any of a number of conventional screening, netting or drainable loose fill materials may be employed for the purpose of preventing excess mortar droppings, debris and/or subsequently installed insulation materials from falling onto the collection surfaces 18 of the pans 12 and blocking the drainage channels of the pans.

Screening or other filtering materials may likewise be installed at the channel openings 36 of the water collection pans to prevent insects and debris from entering through these openings.

It will be appreciated that the water collection pans may be utilized to provide a simple flashing system for unit masonry wall systems regardless of the type of masonry unit utilized. The collection pans can be designed and installed to provide an effective drainage system, even where there are a variety of unit types (i.e., bond beam, stretch, open-ended) utilized within the wall system. Moreover, the water collection pans may be designed so that they are inexpensive and easy to manufacture, may be shipped and stored compactly, and may be quickly sized at the job site.

Figure 15:
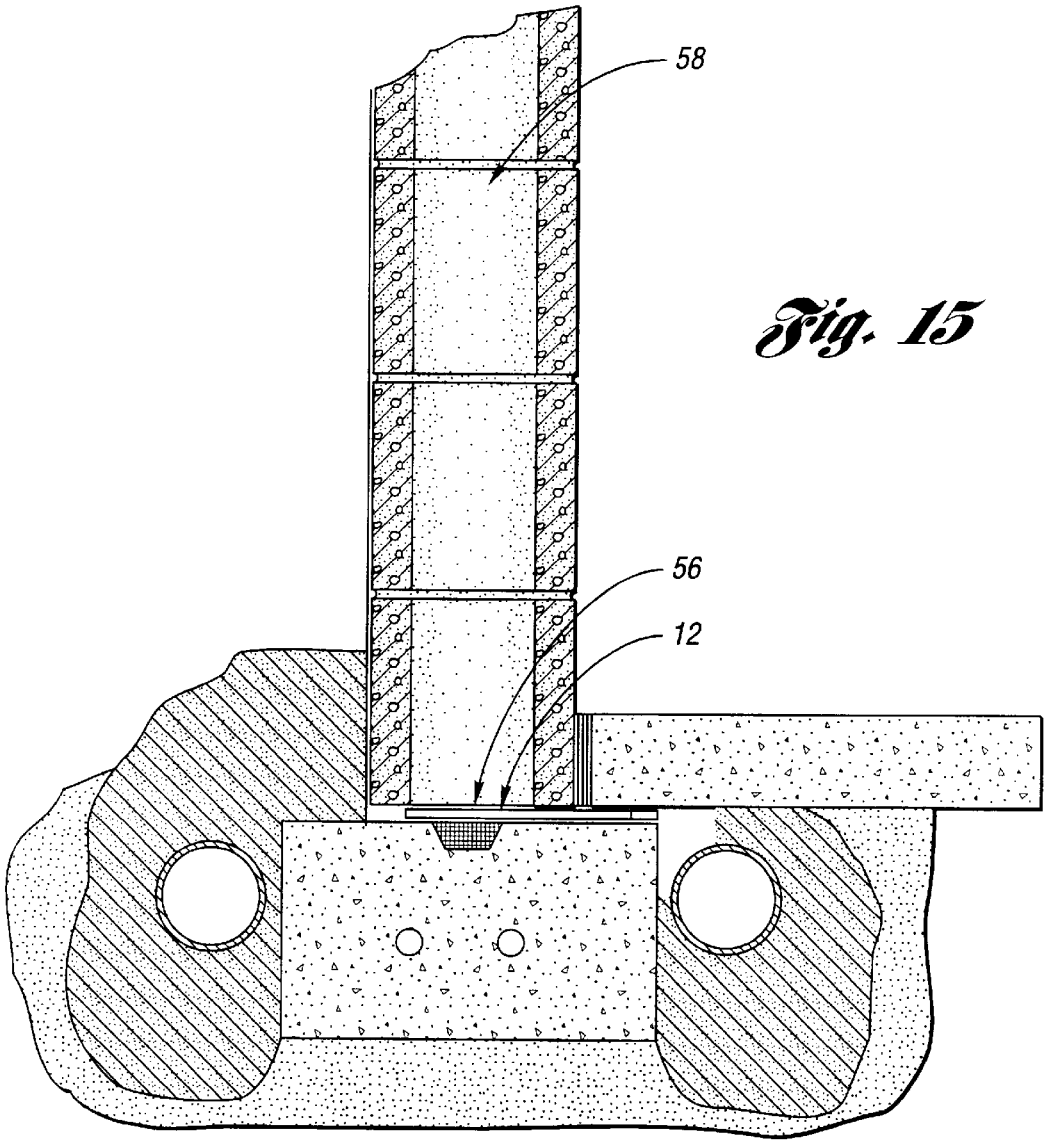
FIG. 15 is a partial side cross sectional view of the system of the present invention installed in an insulated basement wall.

It will also be appreciated that, although the water collection pans and drainage systems of the present invention are described primarily in the context of their various implementations to affect water drainage above ground, the system of the present invention is equally applicable for use in collecting and diverting water in below grade masonry block walls. In this context, it will be appreciated that the water collection pans described herein may be oriented to divert the water from the cores inside the masonry blocks in the wall to the interior surface or to the exterior, as desired, depending upon the type of drainage system employed for that foundation. Examples, of different installations of the system 10 are over mid-wall bond beam courses (FIG. 12), at the base of a wall (FIG. 13), over the header course (FIG. 14), or at the base of a basement wall (FIG. 15). Other common utilizations (not shown) include below sills, over angle iron blocks, over I-beam blocks, and at parapets.

While the best mode for carrying out the invention has been described in detail, those familiar with the art to which this invention relates will recognize various alternative designs and embodiments for practicing the invention as disclosed by the following claims.

What is claimed is:

1. A water collection pan for use in a masonry block wall having at least one upper block course and a lower block course, wherein each upper block course includes at least one block having at least one hollow core, and wherein the lower block course includes a bed joint of mortar separating the blocks in the lower block course from the adjacent upper block course, the collection pan comprising:

a substantially planar collector surface for positioning on the top surface of a block in the lower block course such that, when the collection pan is positioned on the top surface of a block in the lower block course, the collector surface extends across substantially the entire width of the block, the collector surface including front, rear and side edges;

at least the front and rear edges each including a ridge extending generally vertically from the edge to aid in providing a barrier which directs water towards the collector surface of the pan; and a drainage channel extending from the collector surface such that, when the collection pan is positioned on the top surface of a block in the lower block course, the drainage channel extends to the front wall of the block across the bed joint between the lower block and the upper block for draining water to the exterior of the block wall.

2. The water collection pan of claim 1 wherein the pan covers the entire width of the top surface of the block except for about a one inch strip at each of the front and rear edges of the block.

3. The water collection pan of claim 1 wherein the height of each of the ridges extending from the edges of the collector surface is slightly less than the thickness of the bed joint.

4. The water collection pan of claim 1 wherein each of the ridges is about 0.3 inches high.

5. The water collection pan of claim 1 wherein the drainage channel includes a weep spout including a drip edge extending at about a 45° angle from horizontal to divert water draining from the collection pan away from the outer face of the block wall.

6. The water collection pan of claim 1 wherein the opening in the weep spout has an arcuate cross-section to reduce interference with tooling during finishing of the bed joint.

7. The water collection pan of claim 1 wherein the drainage channel includes a ceiling portion spaced above, and generally parallel to, the collector surface and extending into the pan from the front edge of the pan, and a weep spout extending forward from the front edge of the collector surface across the bed joint on the top surface of the block.

8. The water collection pan of claim 7 wherein the ceiling portion of the drainage channel extends across substantially the entire width of the collector surface of the pan.

9. A water drainage system for a masonry block wall having at least one upper block course, a lower block course, and a bed joint separating the blocks in the lower block course from the upper block course, wherein the upper course includes at least one block having at least one hollow core, the water drainage system comprising:

a plurality of water collection pans for positioning on the top surface of each of the blocks of the lower course across the entire length of the lower course for collecting water drained through each core of the upper courses and for directing the water to the exterior of the block wall, wherein at least one of the collection pans includes, substantially planar collector surface for positioning on the top surface of one of the blocks in the lower block course such that, when the collection pan is positioned on the top surface of a block in the lower block course, the collector surface extends across substantially the entire width of the block, the collector surface including front, rear and side edges, each of the front, rear, and side edges including a ridge extending generally vertically from the edge to aid in providing a barrier which directs water towards the collector surface of the pan, and a drainage channel extending from the collector surface such that, when the collection pan is positioned on the top surface of a block in the lower block course, the drainage channel extends toward the front wall of the block across the bed joint for draining water to the exterior of the block wall.

10. The water drainage system of claim 9 further including a plurality of bridge units each of which spans the side edges of two adjacent collection pans to divert descending water onto the collector surfaces of the adjacent pans.

11. The water drainage system of claim 9 further including a drainage enhancing material installed within the vertical cores of the blocks in a course above the collector pans to reduce clogging from mortar and grout droppings.

12. The water drainage system of claim 9 further including a screen material installed over the collector surfaces of the pans to prevent loose fill insulation from the vertical cores of the upper corses of the blocks from filling the pans.

13. The water drainage system of claim 9 further including a layer of pea stone installed in the vertical cores of the blocks above the water pans.

14. A water collection pan for use in a masonry block wall having at least one upper block course and a lower block course, wherein each upper block course includes at least one block having at least one hollow vertical core, and wherein the lower block course includes a bed joint of mortar separating the blocks in the lower block course from the adjacent upper block course, the collection pan comprising:

a substantially planar collector surface for positioning on the top surface of a block in the lower block surface such that, when the collection pan is positioned on the top surface of a block in the lower block course, the collector surface extends across substantially the entire width of the block, the collector surface including front, rear and side edges;

each of the front, rear and side edges including a ridge extending generally vertically from the edge to a height of slightly less than the thickness of the bed joint to aid in providing a barrier which directs water towards the collector surface of the pan; and a drainage channel including a ceiling portion spaced above, and generally parallel to, the collector surface and extending into the pan from the front edge of the pan, and a weep spout extending forward from the front edge of the collector surface such that, when the collection pan is positioned on the top surface of a block in the lower block course, the weep spout extends across the bed joint on the top surface of the block, the weep spout including a generally concave sidewall, and a lower drip edge which extends outward from the opening of the weep spout at an angle of about 45° from horizontal to direct moisture collected on the collector surface of the pans to the exterior of the wall system.

* * * * *

UNITED STATES PATENT AND TRADEMARK OFFICE

CERTIFICATE OF CORRECTION

PATENT NO. : 6,202,366 B1
DATED : March 20, 2001
INVENTOR(S) : Gabrielli et al.

It is certified that error appears in the above-identified patent and that said Letters Patent is hereby corrected as shown below:

Abstract,
Line 2, change "amonia" to "ammonia".

Signed and Sealed this

Sixth Day of November, 2001

*Attest:*

Nicholas P. Godici

NICHOLAS P. GODICI
*Acting Director of the United States Patent and Trademark Office*

*Attesting Officer*